US007147112B2

(12) United States Patent
Penson

(10) Patent No.: US 7,147,112 B2
(45) Date of Patent: Dec. 12, 2006

(54) STACKABLE HAT STORAGE UNITS WITH MULTIPLE MOUNTING ELEMENTS

(76) Inventor: Alphonia Penson, 1561 Unionport Rd., Apt. 5B, Bronx, NY (US) 10462

( * ) Notice: Subject to any disclaimer, the term of this patent is extended or adjusted under 35 U.S.C. 154(b) by 194 days.

(21) Appl. No.: 11/008,828

(22) Filed: Dec. 10, 2004

(65) Prior Publication Data

US 2006/0124563 A1 Jun. 15, 2006

(51) Int. Cl.
*A47F 7/06* (2006.01)

(52) U.S. Cl. ..... 211/30; 211/118; 211/85.3

(58) Field of Classification Search ..... 211/30–32, 211/113, 118, 55, 85.3, 119.004; 206/8, 206/9; 223/12, 24; D6/315
See application file for complete search history.

(56) References Cited

U.S. PATENT DOCUMENTS 2,114,519 A * 4/1938 Beehler ..... 211/30
5,348,166 A * 9/1994 Lema ..... 211/30
5,683,002 A * 11/1997 Rayside ..... 211/30
6,588,604 B1 * 7/2003 Tseng ..... 211/40

* cited by examiner

*Primary Examiner*—Jennifer E. Novosad
(74) *Attorney, Agent, or Firm*—Steven Horowitz

(57) ABSTRACT

Stackable hat storage unit has frame defining a rectangular opening and comprising top, bottom, left and right side panels, parallel horizontal strings that traverse the opening attached to the left and right side panels, the strings spaced so that a folded cap on the string conceals a portion of a similarly folded cap on an adjacent string, the top panel including a vertical notch to receive a hanger-type hook for mounting the frame onto a crossbar and two vertical wall notches to receive screws projecting from a wall, the top panel of the frame curving forward and projecting downwardly to form a top panel lip covering part of the top panel's height, a top portion of the top panel having an upside down "U" cross-section, the top panel lip fitting over a top edge of the bottom panel of a second frame to form a plurality of frames that function together.

14 Claims, 5 Drawing Sheets

STACKABLE HAT STORAGE UNITS WITH MULTIPLE MOUNTING ELEMENTS

FIELD OF THE INVENTION

The field of this invention is hat storage systems, and more particularly, storage assemblies for "baseball cap" type hats.

BACKGROUND OF THE INVENTION AND DISCUSSION OF THE PRIOR ART

The term "baseball cap type hats" refers herein to baseball caps and similar hats in which a rigid brim of the cap is attached to a flexible portion that covers the head. Baseball caps and other baseball cap type hats are very popular. They are inexpensive, they block the rain and the sun, they are versatile in that they can be thin for hot weather and thicker for colder weather, and they come in varied colors and designs. Individuals who are prone to wear such hats tend to have many of them. Thus there is a need for a convenient storage system for such hats.

Furthermore, it is not always possible to hang prior art hat storage systems because some individuals may prefer to store such caps on the back of a bedroom or office door, others may prefer to store such an assembly on a wall, and still others may prefer to store such caps on the horizontal rod extending across a closet. Thus there is a need for a storage system that has diverse and multiple mounting means.

The clothing storage space of people vary widely. Some individuals may have a lot of vertical space within a narrow horizontal space and others may have a more cubic-shaped area for storage of clothing and accessories. Thus there is a need for a baseball cap storage means that can be arranged to capitalize on the particular shape of clothing and accessories storage space available to the individual.

SUMMARY OF THE PRESENT INVENTION

A stackable hat storage unit has a frame defining a rectangular opening and comprising a top, bottom, left and right side panels, parallel horizontal strings that traverse the opening attached to the left and right side panels, the strings spaced so that a folded cap on the string conceals a portion of a similarly folded cap on an adjacent string, the top panel including a vertical notch to receive a hanger-type hook for mounting the frame onto a crossbar and including two vertical wall notches to receive screws projecting from a wall, the top panel of the frame curving forward and projecting downwardly so as to form a top panel lip that covers part of the top panel's height, a top portion of the top panel having an upside down "U" cross-section, the top panel lip fitting over a top edge of the bottom panel of a second frame to form a plurality of frames that function together. An alternative mounting element has a substantially "S" shaped cross section and having a top portion and a bottom portion, the bottom portion having a substantially "U" shaped cross section and curved to fit between the top panel lip and the top portion of the top panel of the frame and the top portion having a cross section of a substantially inverted "U" and curved so as to fit over a crossbar.

IMPORTANT OBJECTS AND ADVANTAGES

The following important objects and advantages of the present invention are:

(1) to provide a hat storage assembly;

(2) to provide a hat storage assembly that stores baseball hats and other hats having similar sized brims;

(3) to provide a hat storage assembly that is lightweight;

(4) to provide a hat storage assembly that is easy to transport anywhere;

(5) to provide a hat storage assembly that can be hung on the horizontal rod of an indoor closet;

(6) to provide a hat storage assembly wherein one hat holder can be stacked directly on another identical hat holder;

(7) to provide a hat storage assembly wherein the hats can be nested one on top of the other;

(8) to provide a hat storage assembly that can be hung on the back of a door;

(9) to provide a hat storage assembly that can be hung on a wall;

(10) to provide a hat storage assembly that can be mounted in multiple ways that are highly popular and accessible;

(11) to provide a hat storage assembly that can be rolled;

(12) to provide a hat storage assembly that can be made fragrant by including an air freshener in a pocket compartment;

(13) to provide a hat storage assembly that can be combined with a disposable refuse bag;

(14) to provide a hat storage assembly that is safe;

(15) to provide a hat storage assembly that can be used by persons of varying heights, including children and adults;

(16) to provide a hat storage assembly that is durable;

(17) to provide a hat storage assembly that is secure; and

(18) to provide such a hat storage unit or units that can be arranged to accommodate the particular shape of clothing and clothing accessory storage space that a person has available.

DETAILED DESCRIPTION OF THE PREFERRED EMBODIMENT

Figure 1:
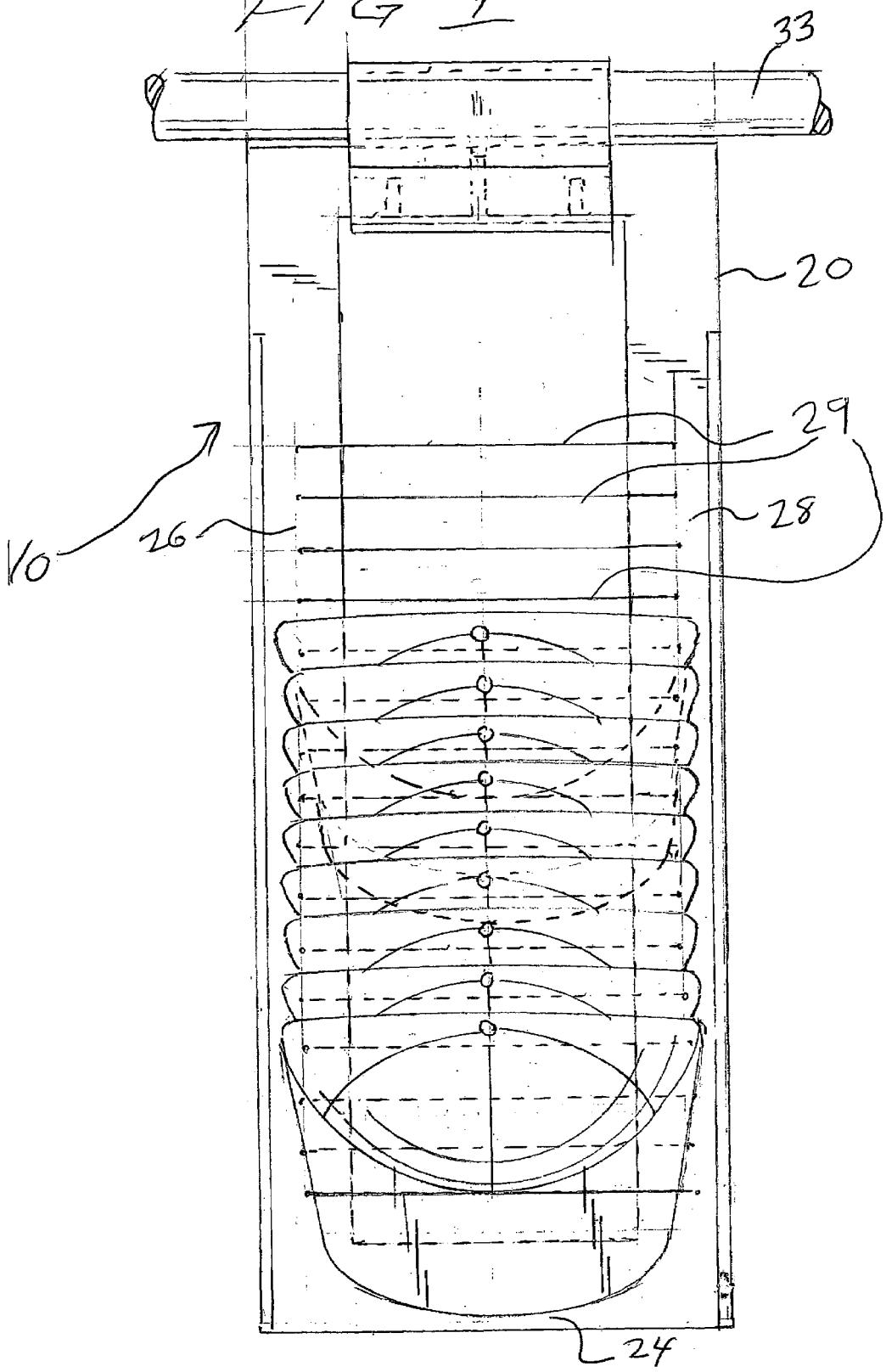
FIG. 1 is a front elevational view of the hat storage assembly of the present invention.

The apparatus of the present invention will now be illustrated by reference to the accompanying drawings. The hat storage unit of the present invention has been assigned reference numeral 10 Other elements have been assigned the reference numerals referred to below.

As seen from FIGS. 1–8, hat storage unit 10 includes a frame 20 defining a substantially rectangular centrally positioned opening. Preferably, the outer perimeter of the frame itself is also substantially rectangular. It is also contemplated by the present invention that, alternatively, the outer perimeter of the frame 20 can deviate from that shape due to decorative purposes or due to additional elements for added stability.

The frame 20 is comprised of a top panel 22, a bottom panel 24, a long left side panel 26 and a long right side panel 28. A series of substantially parallel horizontal strings 29 traverse the rectangular opening and are attached to the long left side panel 26 and to the long right side panel 28.

Figure 2:
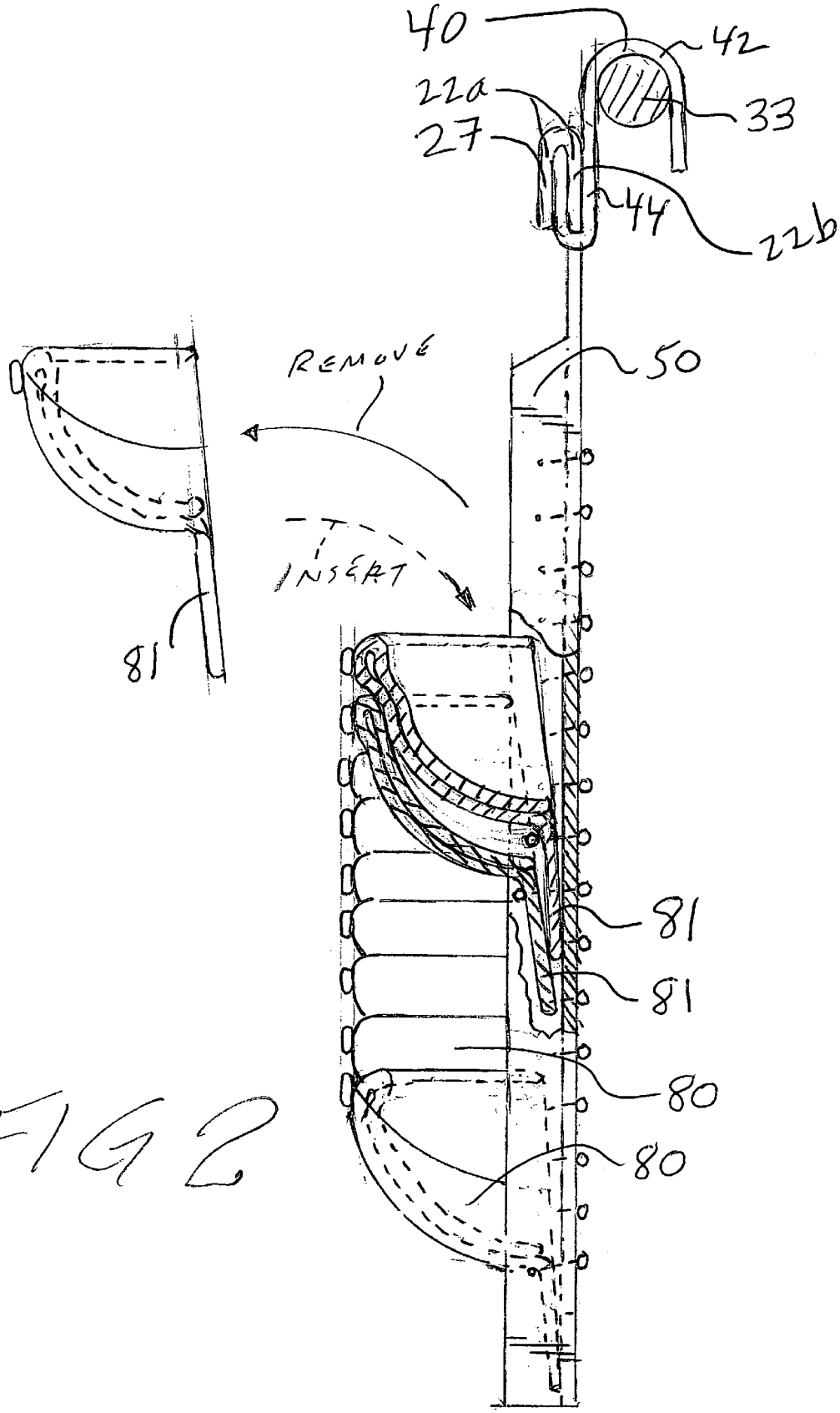
FIG. 2 is a side elevational view, partly in section, thereof with caps nested thereon.
Figure 3:
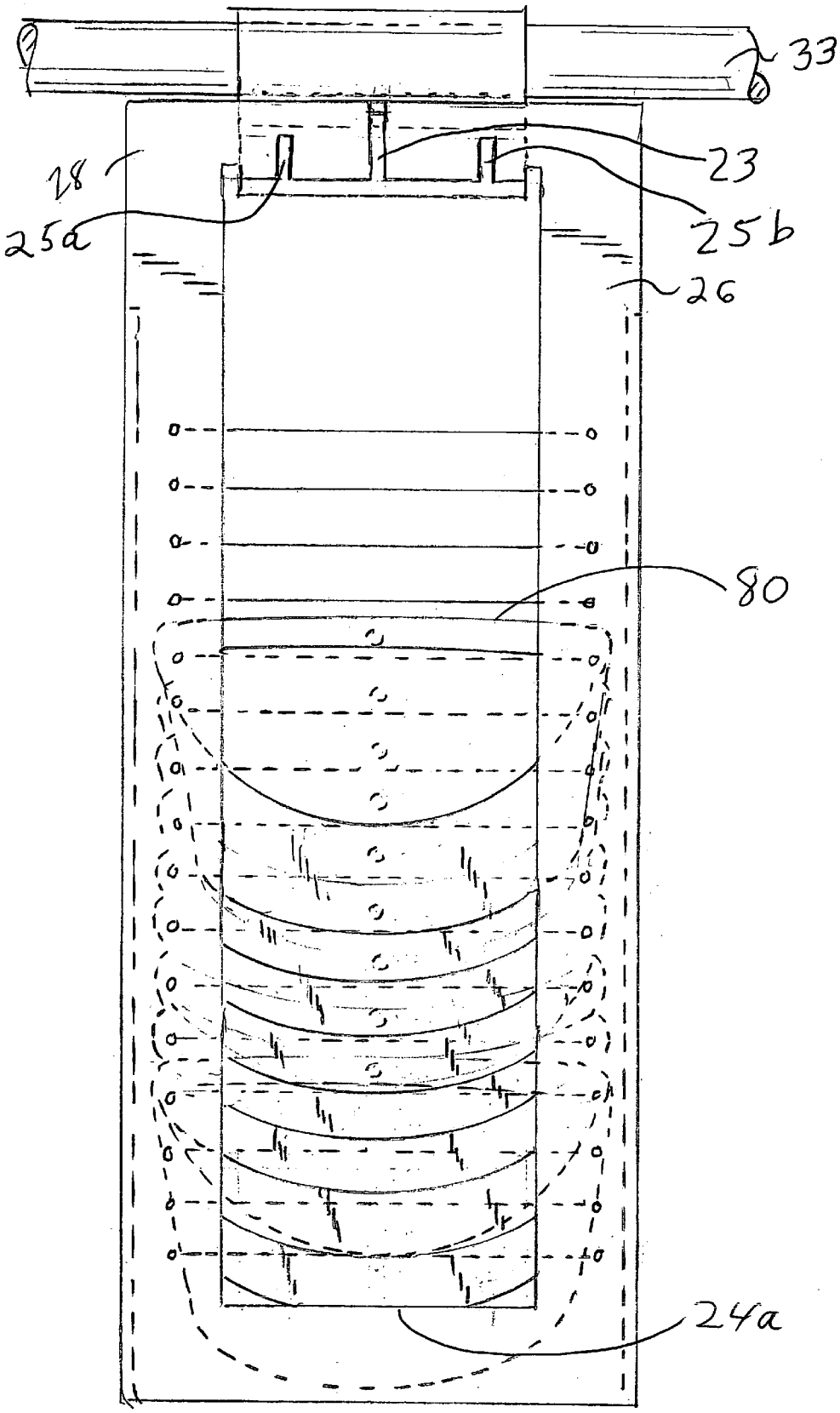
FIG. 3 is a rear elevational view of the hat storage assembly of the present invention.
Figure 5:
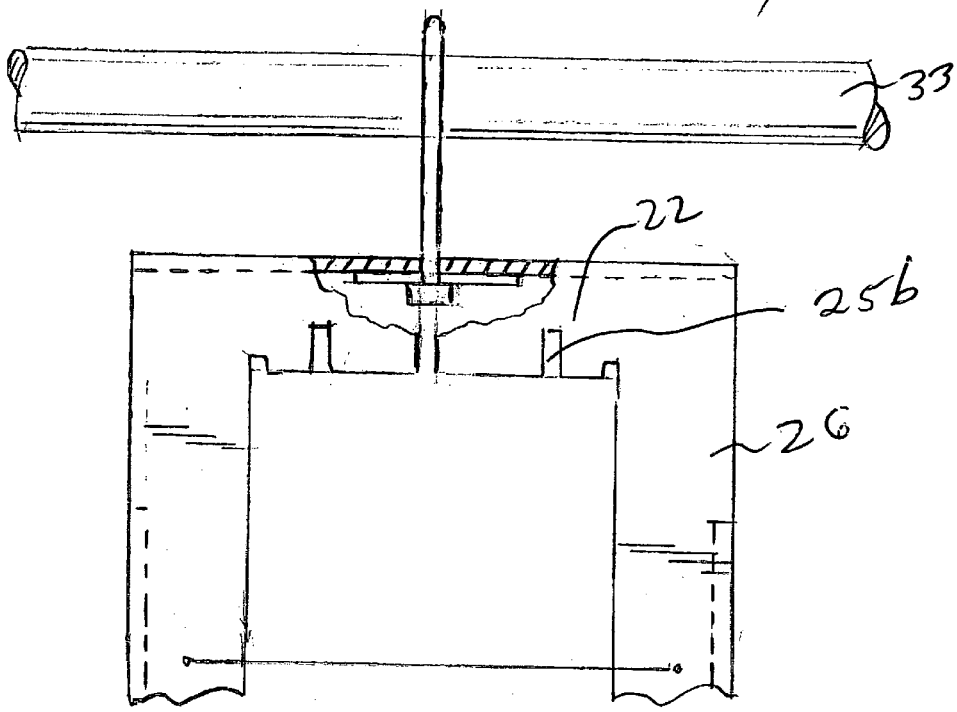
FIG. 5 is a fragmentary rear view taken along line 5—5 of FIG. 4.

As best from FIGS. 1–3, the parallel horizontal strings are spaced apart so that the storage of a folded baseball cap on a horizontal string whereby a brim 81 of the cap 80 rests between the string 29 and frame 20 conceals a portion of a similarly folded cap 80 stored on an adjacent horizontal string 29. The distance between the long left side panel 26 and the long right side panel 28 is such that the frame opening comfortably accommodates the width of the brim of even a large baseball cap.

Figure 4:
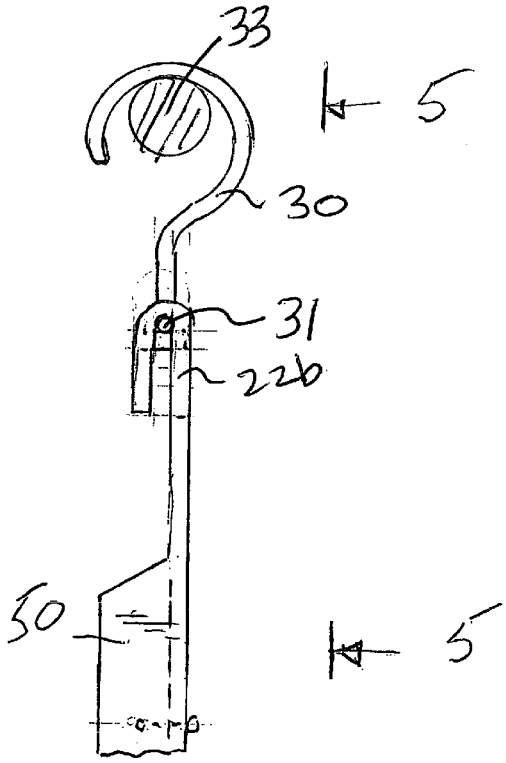
FIG. 4 is a fragmentary side view of another type of hook used in the hat storage assembly of the present invention.
Figure 7:
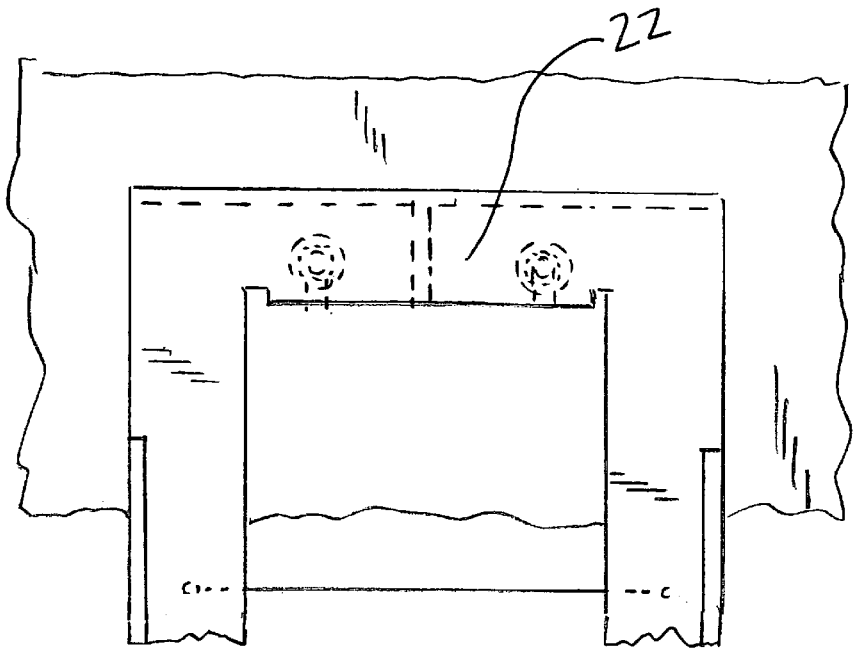
FIG. 7 is a fragmentary front view taken along line 7—7 of FIG. 6.

The top panel 22 includes a vertical notch 23 in a midpoint of the top panel 22, the vertical notch 23 beginning adjacent the top portion of the rectangular opening and extending through almost all of the height of the top panel 22. As best seen in FIG. 4, the vertical notch 23 is capable of receiving a balled end of a hanger-type hook 30 for mounting the frame 20 onto a crossbar 33. Preferably, the hanger-type hook 30 has a security rod 32 perpendicular to the hanger-type hook 30 just above the balled end 31 of the hanger-type hook 30 in order to prevent accidental separation of the hanger-type hook 30 from the frame 20.

The top panel 22 also includes at least two vertical wall notches 25*a*, 25*b* equidistantly spaced from the vertical notch 23. Each of the at least two vertical wall notches 25*a*, 25*b* begin adjacent the opening and extending through a portion of the height of the top panel 22. Typically, the at least two vertical wall notches 25*a*, 25*b* are shorter than the vertical notch 23.

As best seen in FIGS. 3, 5, 6, 7, each of the at least two vertical wall notches 25*a*, 25*b* receive a screw or equivalent attachment accessory that projects from a wall on which the frame 20 is to be hung.

Figure 8:
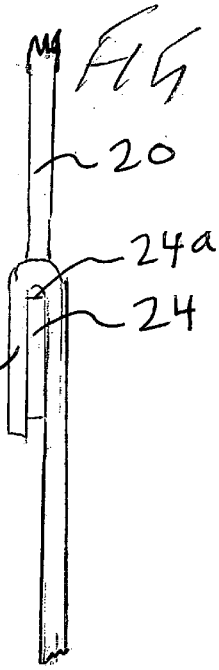
FIG. 8 is a fragmentary side view of two holders hooked together.
Figure 6:
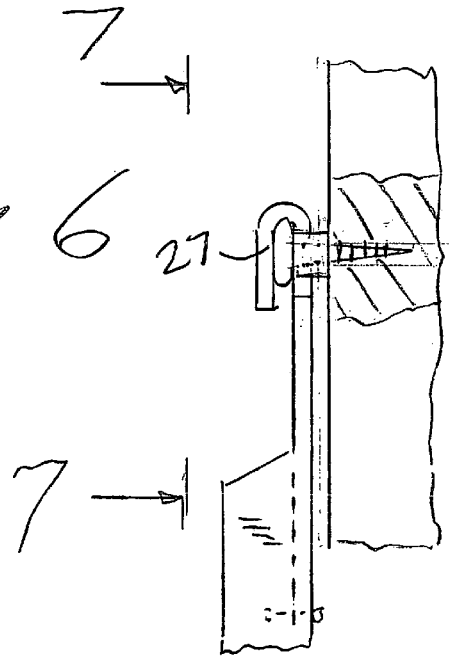
FIG. 6 is a fragmentary side view of another alternative hanging support used in the hat storage assembly of the present invention.

As best seen in FIG. 2, the top panel 22, at a top end of the top panel 22, curves forward and project downwardly so as to form a top panel lip 27 that covers a portion of the height of the top panel 22. Lip 27 should not descend so far as to obstruct the rectangular opening defined by frame 22 but in theory lip 27 could descend as far as top frame 22, although that would not be ideal since it would be unnecessary and would add weight to the hat storage unit. Moreover, it would not be visually appealing. As a result of the existence of lip 27, an upper portion 22*a* of the top panel 22 has a cross-section of an upside down "U", whether or not the two legs of this "U" are of equal length. As seen in FIG. 8, the top panel lip 27 of the frame 20 is capable of fitting snugly over a top edge 24*a* of the bottom panel 24 of a frame 20 of a second hat storage unit so as to form an assembly of hat storage units that function together. Thus, the user can maximize an area of vertical space by stacking two or more hat storage units on top of one another and then mount the assembly on a door, rack, bar or wall or other location.

In order to mount a hat storage unit 10 of the present invention on to a crossbar, for example a crossbar of a closet, the present invention, in certain embodiments includes a special mounting element 40. As best seen from FIG. 2, the mounting element 40 has a substantially "S" shaped cross section. The mounting element 40 can be viewed as having a top portion 42 and a bottom portion 44, the bottom portion 44 itself having a substantially "U" shaped cross section. Bottom portion 44 of mounting element 40 is curved so as to fit between the top panel lip 27 and an uppermost portion 22*b* of top panel 22, which uppermost portion 22*b* forms a part of upper portion 22*a* of top panel 22 of frame 20. Top portion 42 of mounting element 40 has a cross section of a substantially inverted "U" and is curved so as to fit over a crossbar.

An assembly of hat storage units can be made out of several hat storage units of present invention, as previously described. Thus the assembly would comprise a plurality of hat storage units stacked one above another, each hat storage unit in the plurality of hat storage units composing the elements described above. The hat storage units in the plurality of storage units are stacked one above the other in that the top panel lip 27 of the frame 20 of a particular hat storage unit 10 fits comfortably over a top edge 24*a* of the bottom panel 24 of the frame 20 of an adjacent hat storage unit 10 above that particular hat storage unit 10.

In the assembly of hat storage units, the mounting element 40 would be stationed on the highest hat storage unit 10.

As best appreciated from FIG. 2, in certain embodiments of hat storage unit 10, in order to achieve additional stability, frame 20 has projecting from the long left side panel 26 and/or from the long right side panel 28 in the front of these panels a support frame 50. It is contemplated by the present invention that one skilled in the art can modify the hat storage unit 10 of the present invention in various ways from that described above and yet still be within the scope of the present invention. For example, it is contemplated by the present invention that one skilled in the art would be able to add features such as support frame 50 and many other such types of stabilizing structures to order enhance the strength, durability, stability and workability of hat storage unit 10. Similarly, it is also contemplated by the present invention that one skilled in the art would be able to add various kinds of ornamental features to hat storage unit 10 in order to enhance the visual appeal thereof.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A hat storage unit, comprising:

a frame defining a substantially rectangular centrally positioned opening, the frame comprising a top panel, a bottom panel, a long left side panel and a long right side panel, a series of substantially parallel horizontal strings that traverse the opening and are attached to the long left side panel and to the long right side panel, the parallel horizontal strings spaced apart so that a storage of a folded cap on a horizontal string whereby a brim of the cap rests between the string and the frame conceals a portion of a similarly folded cap stored on an adjacent horizontal string, a distance between the long left side panel and the long right side panel sized to comfortably accommodate a width of the brim of a cap, the top panel including a vertical notch in a midpoint of the top panel, the vertical notch beginning adjacent the opening and extending through almost all of a height of the top panel, the vertical notch capable of receiving a balled end of a hanger-type hook for mounting the frame onto a crossbar, the top panel also including at least two vertical wall notches equidistantly spaced from the vertical notch, each of the at least two vertical wall notches beginning adjacent the opening and extending through a portion of the height of the top panel, each of the at least two vertical wall notches for receiving a screw that projects from a wall on which the frame is to be hung, the top panel at a top end thereof curving forward and projecting downwardly so as to form a top panel lip that covers a portion of a height of the top panel and so that an upper portion of the top panel has a cross-section of an upside down "U", the top panel lip of the frame capable of fitting over a top edge of the bottom panel of a second frame to form an assembly of frames that function together.

2. The hat storage unit of claim 1, including a mounting element having a substantially "S" shaped cross section and having a top portion and a bottom portion, the bottom portion having a substantially "U" shaped cross section and curved to fit between the top panel lip and an uppermost portion of the top panel of the frame and the top portion having a cross section of a substantially inverted "U" and curved so as to fit over a crossbar.

3. The hat storage unit of claim 1, including the hanger-type hook.

4. The hat storage unit of claim 3, wherein the hanger-type hook has a security rod perpendicular to the hanger-type hook just above the balled end of the hanger-type hook in order to prevent accidental separation of the hanger-type hook from the frame.

5. The hat storage unit of claim 1, including a mounting element having a substantially "S" shaped cross section and having a top portion and a bottom portion, the bottom portion having a substantially "U" shaped cross section and curved to fit between the top panel lip and an uppermost portion of the top panel of the frame and the top portion having a cross section of a substantially inverted "U" and curved so as to fit over a crossbar and including the hanger-type hook.

6. The hat storage unit of claim 5, wherein the hanger-type hook has a security rod perpendicular to the hanger-type hook just above the balled end of the hanger-type hook in order to prevent accidental separation of the hanger-type hook from the frame.

7. The hat storage unit of claim 1, wherein an outer perimeter of the frame is substantially rectangular.

8. An assembly of hat storage units, comprising:

a plurality of hat storage units stacked one above an other, each hat storage unit in the plurality of hat storage units comprising a frame defining a substantially rectangular centrally positioned opening, the frame comprising a top panel, a bottom panel, a long left side panel and a long right side panel, a series of substantially parallel horizontal strings that traverse the opening and are attached to the long left side panel and to the long right side panel, the parallel horizontal strings spaced apart so that a storage of a folded cap on a horizontal string whereby a brim of the cap rests between the string and the frame conceals a portion of a similarly folded cap stored on an adjacent horizontal string, a distance between the long left side panel and the long right side panel sized to comfortably accommodate a width of the brim of a cap, the top panel including a vertical notch in a midpoint of the top panel, the vertical notch beginning adjacent the opening and extending through almost all of a height of the top panel, the vertical notch capable of receiving a balled end of a hanger-type hook for mounting the frame onto a crossbar, the top panel also including at least two vertical wall notches equidistantly spaced from the vertical notch, each of the at least two vertical wall notches beginning adjacent the opening and extending through a portion of the height of the top panel, each of the at least two vertical wall notches for receiving a screw that projects from a wall on which the frame is to be hung, the top panel at a top end thereof curving forward and projecting downwardly so as to form a top panel lip that covers a portion of a height of the top panel and so that a top portion of the top panel has a cross-section of an upside down "U", the hat storage units in the plurality of storage units stacked one above the other in that the top panel lip of the frame of a particular hat storage unit fits over a top edge of the bottom panel of the frame of an adjacent hat storage unit above that particular hat storage unit.

9. The assembly of claim 8, including a mounting element having a substantially "S" shaped cross section and having a top portion and a bottom portion, the bottom portion having a substantially "U" shaped cross section and curved to fit between the top panel lip and an uppermost portion of the top panel of the frame of a highest hat storage unit in the plurality of hat storage units and the top portion having a cross section of a substantially inverted "U" and curved so as to fit over a crossbar.

10. The assembly of claim 8, wherein in each hat storage unit there is included the hanger-type hook.

11. The assembly of claim 10, wherein in each hat storage unit the hanger-type hook has a security rod perpendicular to the hanger-type hook just above the balled end of the hanger-type hook in order to prevent accidental separation of the hanger-type hook from the frame.

12. The assembly of claim 8, including a mounting element having a substantially "S" shaped cross section and having a top portion and a bottom portion, the bottom portion having a substantially "U" shaped cross section and curved to fit between the top panel lip and an uppermost portion of the top panel of the frame of a highest hat storage unit in the plurality of hat storage units and the top portion having a cross section of a substantially inverted "U" and curved so as to fit over a crossbar and wherein in each hat storage unit there is included the hanger-type hook.

13. The assembly of claim 12, wherein the hanger-type hook in each hat storage unit has a security rod perpendicular to the hanger-type hook just above the balled end of the hanger-type hook in order to prevent accidental separation of the hanger-type hook from the frame.

14. The assembly of claim 8, wherein an outer perimeter of the frame of each hat storage unit is substantially rectangular.

* * * * *